US007720426B2

(12) United States Patent
Watanabe et al.

(10) Patent No.: US 7,720,426 B2
(45) Date of Patent: May 18, 2010

(54) CLEANING DEVICE AND IMAGE FORMING APPARATUS USING THE SAME

(75) Inventors: Takeshi Watanabe, Kanagawa-ken (JP); Mitsuaki Kouyama, Tokyo (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 765 days.

(21) Appl. No.: 11/668,187

(22) Filed: Jan. 29, 2007

(65) Prior Publication Data

US 2008/0181690 A1 Jul. 31, 2008

(51) Int. Cl.
*G03G 21/00* (2006.01)

(52) U.S. Cl. ..... 399/350

(58) Field of Classification Search ..... 399/350, 399/343, 357

See application file for complete search history.

(56) References Cited

U.S. PATENT DOCUMENTS 3,728,016 A * 4/1973 Harbour et al.
6,226,484 B1 * 5/2001 Ichikawa et al.
6,266,502 B1 7/2001 Matsuzaki et al.
6,829,464 B2 * 12/2004 Haraguchi et al.

FOREIGN PATENT DOCUMENTS

JP 06149097 A * 5/1994
JP 2003-226773 8/2003
JP 2003-231769 8/2003
JP 2005-234382 9/2005

OTHER PUBLICATIONS

Korean Office Action dated Mar. 10, 2009 corresponding to U.S. Appl. No. 11/668,187, filed Jan. 29, 2007.

* cited by examiner

*Primary Examiner*—Susan S Lee
(74) *Attorney, Agent, or Firm*—Turocy & Watson, LLP

(57) ABSTRACT

A cleaning device excellent in cleaning performance and durability and an image forming apparatus using the same are provided. The cleaning device includes an edge part coming into contact with the surface of the image carrier; the edge part is made of an elastic expanded body having an expanded cell; and number particle size distribution values D10 and D90 of the expanded cell meet the following requirements (1) and (2) against a number particle size distribution value D10 of the toner. (1) The number particle size distribution value D10 of the expanded cell is ¼ times or more of the number particle size distribution value D10 of the toner. (2) The number particle size distribution value D90 of the expanded cell is not more than 50 times of the number particle size distribution value D10 of the toner.

12 Claims, 7 Drawing Sheets

CLEANING DEVICE AND IMAGE FORMING APPARATUS USING THE SAME

BACKGROUND OF THE INVENTION

1. Field of the Invention

The present invention relates to a cleaning device and to an image forming apparatus using the same. In detail, the invention relates to a cleaning device excellent in cleaning performance and durability and to an imaging forming apparatus using the same.

2. Description of the Related Art

A general electrophotographic process includes a step of charging an image carrier such as a photoconductor; a step of forming an electrostatic latent image on the photoconductor by image exposure; a step of developing the electrostatic latent image with a toner to form a toner image; a step of transferring the toner image onto a material to be transferred; and a step of cleaning the residual toner on the photoconductor, and further includes a step of destaticizing the photoconductor as the need arises. In a development step of a dry electrophotographic system, a toner image is formed by using a powdered toner, which is then transferred onto a material to be transferred such as paper and an intermediate transfer medium. The residual toner on the photoconductor after the transfer or the toner which has not been transferred from the photoconductor due to a paper jam or the like is removed from the photoconductor in a subsequent cleaning step by a cleaner such as a blade, a brush applied with a bias, and a roller.

For example, though a blade cleaning system can be configured relatively cheaply, it is insufficient for cleaning a toner which is in general a fine particle; and for the purpose of obtaining a sufficient cleaning performance, when the blade is brought into strong contact with the photoconductor, an edge part of the blade is partially broken, or the blade is turned up. And, when the edge part of the blade is broken or turned up, a cleaning performance set up at the beginning is not obtained, cleaning failure occurs, and a serious defect is generated on an image.

Then, there is taken a countermeasure for widening a margin of a cleaning condition by containing a fluorocarbon resin in a photoconductor surface portion which is a member to be cleaned or mixing a lubricant such as zinc stearate into a toner, thereby reducing the friction between the blade and the photoconductor surface to make the toner easy to peel away from the photoconductor. However, if a large amount of a mold releasing agent is mixed in the photoconductor surface portion, characteristics of the photoconductor must be sacrificed to some extent, and it is difficult to obtain a photoconductor with high performance. Also, if a lubricant is mixed in the toner, a charging performance as the toner is influenced not a few, and it is difficult to obtain a toner with high performance. Also, even when the foregoing countermeasure is taken, it is difficult to make both sufficient cleaning performance and durability compatible with each other.

Also, in addition to the blade cleaning system, for example, a sponge roller is used as a cleaning measure using a roller. This is a system in which an elastic sponge roller constituted of expanded polyurethane or the like is brought into contact with a photoconductor and a toner is moved into a side of the sponge roller by an electric field and is a system in which cleaning is performed while storing the toner in the sponge roller during the image forming action and the toner is discharged out into a side of the photoconductor between papers on which an image is not formed or at the time of finish action or the like, thereby recovering the toner by a development unit or a separately provided cleaner. Separately from this, there is also known a system in which a metallic roller or the like is further brought into contact with a sponge roller and provided with a blade cleaner or the like, thereby recovering the toner.

In the foregoing cleaning measure using a roller, since the electric field is applied by using the sponge roller, a bearing or a bias feed measure is essential. Also, in the foregoing system of once storing the toner in the roller and then discharging out it, a reversely charged toner or the like cannot be controlled, a problem of deterioration of image quality is inevitable, and simultaneously, a discharge-out action or the like must be frequently carried out, whereby the performance of apparatus is lowered. Also, in the system of recovering the toner by providing a metallic roller or the like, parts such as a metallic roller and a blade are additionally needed, the costs are expensive, and the configuration becomes large in size. Furthermore, even in the foregoing systems, when the particle size of the toner is small, sufficient cleaning becomes difficult. Under these circumstances, there are made some attempts to improve the performance of an elastic roller such as a sponge roller.

For example, JP-A-2003-226773 discloses a method of preparing an expanded elastic roller for cleaning by a supercritical fluid technology and results of use thereof. Furthermore, JP-A-2003-231769 discloses a method of preparing expanded polyurethane by employing a supercritical fluid technology, an expanded sponge roller obtained by the subject method and results of use thereof. According to the expanded sponge roller disclosed in JP-A-2003-231769, it is disclosed that a cleaning performance is improved and that a blade can be prepared in the same configuration.

On the other hand, the blade cleaning is advantageous as a cleaning measure because of a relatively cheap device configuration. Then, the present inventors made expanded blades on an experimental basis in the manufacturing methods disclosed in the foregoing patent documents and carried out tests. As a result, they found the following problems.

(i) When the foregoing expanded blade is formed in a pad-like shape and brought in a fixed area into contact with a photoconductor, though the initial cleaning performance is good, cleaning failure occurs immediately due to plugging.

(ii) When an edge part of the foregoing expanded blade is brought into contact with a photoconductor as in usual blades, a good cleaning performance is not obtained from the beginning. Also, when a paper-passing test is carried out, cleaning failure occurs immediately as the case may be.

(iii) As compared with conventional urethane rubbers, the expanded polyurethane is weak in "elasticity" and narrow in a margin of a cleaning condition, and blade turning up is easy to occur overwhelmingly.

As described above, though JP-A-2003-226773 and JP-A-2003-231769 describe that the elastic expanded body prepared by a supercritical fluid technology can be utilized as a cleaning roller or a blade in an electrophotographic apparatus, even when an expanded blade is prepared merely by the technologies disclosed in these patent documents, a sufficient cleaning performance cannot be obtained. Originally, in the case of blade cleaning, when an expanded body is used, it is just like the matter that "blade breakage" appears to occur from the beginning, and a good cleaning performance cannot be expected. Also, as common sense in the art, the "cleaning using an expanded body" as referred to herein is not blade cleaning but means a technology using a cleaning roller or a cleaning pad. Accordingly, there has not hitherto been made a proposal to venture to employ an elastic expanded body for blade cleaning, thereby improving cleaning performance or durability or the like as in the invention.

SUMMARY OF THE INVENTION

Accordingly, an object of the invention is to provide a cleaning device employing an elastic expanded body for blade cleaning and capable of imparting excellent cleaning performance and durability and an image forming apparatus using the same.

In order to solve the foregoing problems, the cleaning device according to the invention has the following configurations.

(i) A cleaning device disposed in contact with a surface of an image carrier and scraping off a residual toner on the surface of the image carrier, which is characterized in that the cleaning device includes an edge part coming into contact with the surface of the image carrier;

that the edge part is made of an elastic expanded body having an expanded cell; and that number particle size distribution values D10 and D90 of the expanded cell meet the following requirements (1) and (2) against a number particle size distribution value D10 of the toner:

(1) the number particle size distribution value D10 of the expanded cell is ¼ times or more of the number particle size distribution value D10 of the toner, and (2) the number particle size distribution value D90 of the expanded cell is not more than 50 times of the number particle size distribution value D10 of the toner.

(ii) The cleaning device as set forth above in (i), which is characterized in that the edge part has a fine three-dimensional concave-convex structure due to the expanded cell and forms a discontinuous contact surface against the surface of the image carrier.

(iii) The cleaning device as set forth above in (i), which is characterized in that the elastic expanded body has an Asker-C hardness of 15° or more and not more than 80°.

(iv) The cleaning device as set forth above in (iii), which is characterized in that the elastic expanded body has an Asker-C hardness of 35° or more and not more than 80°.

(v) The cleaning device as set forth above in (i), which is characterized in that an area rate of a cell portion in a cross section of the elastic expanded body is 30% or more and not more than 85%.

(vi) The cleaning device as set forth above in (i), which is characterized in that the cleaning device further includes a reinforcing support unit for pressing the elastic expanded body onto the image carrier.

(vii) The cleaning device as set forth above in (i), which is characterized in that the elastic expanded body contains, as an additive, at least one member selected from the group consisting of a carbon nanotube and fullerene.

(viii) The cleaning device as set forth above in (i), which is characterized in that the cleaning device is provided with a destaticization function or a charging function.

(ix) The cleaning device as set forth above in (ii), which is characterized in that the elastic expanded body is one prepared via a step in which after introducing a liquid rubber into a subcritical or supercritical fluid, the subcritical or supercritical fluid is released from the liquid rubber.

(x) The cleaning device as set forth above in (ix), which is characterized in that the subcritical or supercritical fluid is carbon dioxide.

(xi) The cleaning device as set forth above in (i), which is characterized in that a material having a hardness higher than the elastic expanded body is stacked in a back side of the elastic expanded body.

Also, the image forming apparatus according to the invention has the following configuration.

(xii) An image forming apparatus including an image forming unit for forming an electrostatic latent image on an image carrier, a development unit for developing the electrostatic latent image formed by the image forming unit with a toner to form a toner image, a transfer unit for transferring the toner image developed by the development unit onto a material to be transferred, and a cleaning unit disposed in contact with a surface of the image carrier and scraping off the residual toner on the surface of the image carrier after the transfer, which is characterized in that the cleaning unit is composed of the cleaning device as set forth above in (i).

DESCRIPTION OF THE EMBODIMENTS

Embodiments of the invention are hereunder described.

Figure 1:
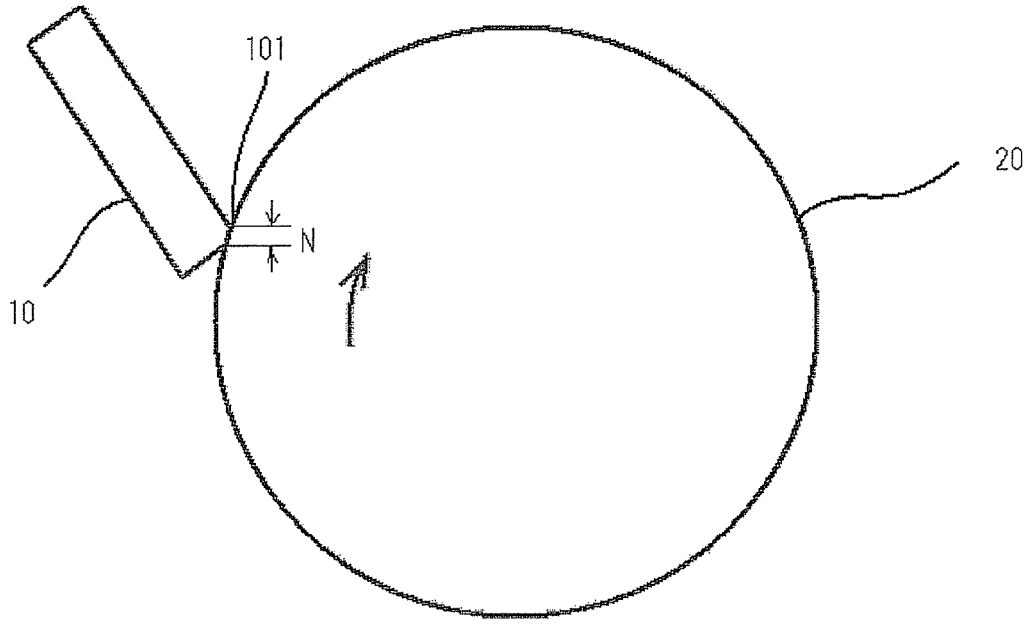
FIG. 1 is an outline cross-sectional view for explaining an embodiment of a cleaning device of the invention.

FIG. 1 is an outline cross-sectional view for explaining an embodiment of a cleaning device of the invention.

A cleaning device 10 of the invention is used for developing an electrostatic latent image formed on a photoconductor by image exposure with a toner, transferring an obtained toner image onto a material to be transferred and then scraping off the residual toner on the photoconductor.

For that reason, the cleaning device 10 of the invention is formed in a block body state; and this works as a blade and comes into contact with a surface of a photoconductor 20 as an image carrier, thereby scraping off the residual toner on the photoconductor 20 rotating in an arrow direction.

In the cleaning device 10 of the invention, a contact part with the photoconductor 20 is an edge part 101 of the blade. In the embodiment of FIG. 1, the cleaning device 10 extends from a downstream side of the rotation direction of the photoconductor 20 toward an upstream direction, and the edge part 101 comes into contact with the photoconductor 20 such that it is opposed to the rotation direction thereof. The edge part 101 is made of an elastic expanded body having an expanded cell, and the invention is characterized in that that number particle size distribution values D10 and D90 of the expanded cell meet the following requirements (1) and (2) against a number particle size distribution value D10 of the toner:

(1) the number particle size distribution value D10 of the expanded cell is ¼ times or more of the number particle size distribution value D10 of the toner, and (2) the number particle size distribution value D90 of the expanded cell is not more than 50 times of the number particle size distribution value D10 of the toner.

In the case where the foregoing requirements (1) and (2) are not met, an improvement in cleaning performance or durability is not obtained.

Preferably, (1) the number particle size distribution value D10 of the expanded cell is ½ times or more and not more than 10 times of the number particle size distribution value D10 of the toner; and (2) the number particle size distribution value D90 of the expanded cell is 2 times or more and not more than 20 times of the number particle size distribution value D10 of the toner.

In the cleaning device 10 of the invention which meets the foregoing requirements, the edge part 101 has a fine three-dimensional concave-convex structure due to the expanded cell and forms a discontinuous contact surface against the surface of the photoconductor 20. In this way, a sufficient cleaning action can be exhibited even against fine particles such as a small-sized toner. Furthermore, since even when the edge part 101 is abraded, a new expanded cell is exposed one after another, a cleaning effect is not lowered over a long period of time. In particular, even when a fine particle such as a toner is spherical, since the expanded cell surely captures the spherical fine particle so that it cannot pass therethrough, cleaning failure which has been conventionally observed does not occur at all.

Meanings of the numerical limitations in the foregoing requirements (1) and (2) are hereunder described. When the expanded cell size is too small, the cell does not work as a knife edge, resulting in the same situation as in a usual cell-free blade. That is, the toner is easy to roll in the edge part, and in particular, a small-sized toner passes through the blade. An appropriate range of the expanded cell size is correlated with the particle size of the toner, and the number particle size distribution value D10 of the expanded cell is required to be ¼ times or more of the number particle size distribution value D10 of the toner. That is, when the number particle size distribution value D10 of the expanded cell is less than ¼ times of the number particle size distribution value D10 of the toner, the expanded cell size is too small; and as described previously, the cell does not work as a knife edge, the toner is easy to roll in the edge part, and in particular, a small-sized toner passes through the blade. Also, it is not the case that what the size of the expanded cell is large is better, and the number particle size distribution value D90 of the expanded cell is required to be not more than 50 times of the number particle size distribution value D10 of the toner. When the size of the expanded cell is larger than this range, a cleaning margin is remarkably lowered due to the matter that in the edge part, a difference in pressure against the photoconductor surface between a part where the cell is present and a part where the cell is not present becomes excessively large; and the matter that in the edge part, only one cell is able to play a role of the knife edge and an optimum knife edge state is not obtained depending upon an angle of the cell. Incidentally, the sharper the distribution of the expanded cell size, the more excellent the cleaning performance.

The elastic expanded body having an expanded cell which meets the foregoing requirements (1) and (2) can be prepared by a supercritical fluid technology.

The elastic expanded body in the invention can be prepared via a step in which after introducing a liquid rubber into a subcritical or supercritical fluid, the subcritical or supercritical fluid is released from the liquid rubber.

Examples of the supercritical fluid or subcritical fluid in the invention include carbon dioxide, nitrogen, ethane and ethylene in a supercritical state or subcritical state. In the case where a raw material rubber is classified with respect to a shape at room temperature (from 15 to 30° C.), the "liquid rubber" as referred to in the invention means one which is liquid and flowable.

Examples of the foregoing liquid rubber include liquid urethane rubbers, liquid silicone rubbers, liquid isobutylene rubbers, liquid isoprene rubbers, liquid polybutadiene rubbers, liquid polyalkylene oxides, and hydrogenated isoprene. These are used singly or in combination of two or more kinds thereof. Also, ones which are crosslinkable by a urethane reaction or a hydrosilyl reaction are preferable as the foregoing liquid rubber.

The "liquid urethane rubber" as referred to herein means a raw material rubber which is moldable and crosslinkable in a liquid state, and examples of a liquid molding method include a prepolymer method and a one-shot method. The foregoing prepolymer method is a method in which a polyether polyol or a polyester polyol is reacted with a diisocyanate compound such as toluene diisocyanate (TDI) and diphenylemethane diisocyanate (MDI), thereby converting a molecular terminal into NCO or OH. And, with respect to the foregoing NCO-terminated rubber, a chain extender such as water, glycols and diamines is added to realize a high molecular weight and achieve crosslinking, and an aromatic diamine is used in the TDI system, whereas a mixture of 1,4-butanediol and trimethylolpropane (TMP) is used in the MDI system. Also, the foregoing one-shot method is a method in which raw materials are mixed in one stage and cast.

The foregoing liquid silicone rubber contains, as a major component, a diorganopolysiloxane having a degree of polymerization of from 1,000 to 200,000 and is classified into dimethyl silicone, methyl vinyl silicone, methyl phenyl silicone, and fluorosilicone depending upon the kind of a side chain. The foregoing liquid silicone rubber includes a one-pack type and a two-pack type and can be classified into a room temperature hardening type (RTV) and a heat hardening type (high temperature: HTV, low temperature: LTV) depending upon the hardening temperature or into a condensation type and an addition type depending upon the hardening reaction mechanism, respectively. Also, examples of a functional group for achieving the crosslinking include functional groups containing an alkenyl group such as a vinyl group and functional groups containing a hydroxyl group, an ammonium group or an epoxy group.

A number average molecular weight (Mn) of the foregoing liquid rubber is preferably in the range of from 1,000 to 200,000, and especially preferably in the range of from 2,000 to 50,000.

In order to crosslink the foregoing liquid rubber, in addition to the liquid rubber, a crosslinking agent (hardening agent), a catalyst, a vulcanization accelerator, a vulcanization aid, a blowing agent, a blowing aid, and the like are used as the need arises. Also, in order to impart conductivity, a conductive agent or the like may be blended.

As the foregoing crosslinking agent (hardening agent), an optimum crosslinking agent is used depending upon the kind of the foregoing liquid rubber. Examples of the hardening agent for the foregoing liquid silicone rubber include hydrosilyl hardening agents and organic peroxides which accelerate an addition reaction to a vinyl group, or a dehydration reaction or a condensation reaction of a hydroxyl group.

Though the foregoing catalyst is not particularly limited so far as it is able to exhibit a catalytic function against the crosslinking reaction, a hydrosilylation catalyst is suitably used for the addition reaction. Examples of such a hydrosilylation catalyst include chloroplatinic acid, complexes of chloroplatinic acid and an alcohol, an aldehyde or a ketone, platinum/vinylsiloxane complexes, platinum/olefin complexes, platinum/phosphite complexes, platinum, and catalysts having solid platinum supported on a carrier such as alumina, silica and carbon black; and besides, palladium compounds, rhodium compounds, iridium compounds, and ruthenium compounds. These are used singly or in combination of two or more kinds thereof. Incidentally, as the catalyst of the foregoing crosslinking reaction for a hydroxyl group, an ammonium group or an epoxy group, in addition to the foregoing hydrosilylation catalysts, tin based compounds, amino group-containing compounds, fatty acid salts of a metal (for example, Pb, Zn, Fe, Zr, and Co), and the like may be used. Examples of the foregoing tin based compound include dibutyltin dilaurate and dibutyltin diacetate. Also, examples of the foregoing amino group-containing compound include triethylenediamine (TEDA).

As the foregoing vulcanization accelerator, for example, thiuram based or thiazole based vulcanization accelerators are suitably used. Examples of the foregoing vulcanization aid include ZnO (zinc oxide type 2).

Examples of the foregoing blowing agent include azobisisobutyronitrile (AIBN), azocarbonamide, N,N'-dinitropentamethylenetetramine (DPT), potassium hydrogencarbonate, urea, and 4,4'-oxybis(benzenesulfonylhydrazide). Incidentally, the blowing agent may be auxiliarily used in the invention.

Examples of the foregoing blowing aid include urea based blowing aids, metal oxide based blowing aids, metallic soap based blowing aids, and salicylic acid based blowing aids. These are used singly or in combination of two or more kinds thereof, and an optimum blowing aid is selected depending upon the kind of the foregoing blowing agent. Examples of the foregoing metal oxide based blowing aid include zinc(II) oxide. Examples of the foregoing metallic soap based blowing aid include calcium stearate. Examples of the foregoing salicylic acid based blowing aid include salicylic acid.

Examples of the foregoing conductive agent include carbon black (for example, acetylene black), graphite, potassium titanate, iron oxide, conductive titanium oxide, conductive zinc oxide, conductive indium oxide, and ion conductive agents (for example, quaternary ammonium salts, boric acid salts, and surfactants). These are used singly or in combination of two or more kinds thereof.

Also, a carbon nanotube or a fullerene may be added in the elastic expanded body in the invention. The fullerene has an effect for improving abrasion, and when a proper amount thereof is added, it is able to improve durability of the elastic body itself. Also, since the carbon nanotube is able to obtain high conductivity upon addition of a smaller amount than usual carbon black, it is a very effective additive in the case where it is applied to a blade also working as a destaticization or charging device of a photoconductor, a belt or the like. As the carbon nanotube, known carbon nanotubes can be used, and those having a diameter of from 1 nm to 500 nm and a length of from 10 nm to 500 μm can be used. With respect to the fullerene, ones having a particle size of from 1 nm to 1 μm can be used. The amount of addition of the fullerene is preferably from 0.3 to 30% by mass based on the liquid rubber. The amount of addition of the carbon nanotube is preferably from 0.3 to 30% by mass based on the liquid rubber.

The elastic expanded body of the invention can be, for example, prepared by using the foregoing respective materials in the following manner. That is, first of all, the foregoing liquid rubber and a crosslinking agent (hardening agent), a conductive agent, a carbon nanotube, a fullerene, and so on as the need arises are blended to prepare an expanded body material (in a liquid state), which is then kept in a prescribed shape within a high-pressure chamber. Next, a supercritical fluid or subcritical fluid such as carbon dioxide in a supercritical state or subcritical state is brought into contact with the expanded body material kept within the high-pressure chamber, thereby penetrating and dissolving the supercritical fluid or subcritical fluid in the liquid rubber to achieve impregnation. Next, the pressure within the foregoing high-pressure chamber is decreased to a prescribed range, thereby releasing the supercritical fluid or subcritical fluid impregnated in the liquid rubber, and expansion is achieved by that action. Then, this is taken out from the high-pressure chamber and molded, and for example, crosslinking is performed, whereby a targeted elastic expanded body can be obtained. Incidentally, the elastic expanded body having an expanded cell which meets the foregoing requirements (1) and (2) is obtained by properly selecting the foregoing expansion condition, for example, a pressure condition within the high-pressure chamber, an expansion temperature, an expansion time, a crosslinking temperature, and a crosslinking time. In the case of expanding the liquid rubber in this way, there is brought an advantage that the cell is easily uniformly distributed and formed because the liquid rubber has softness as compared with a solid rubber. Also, since the liquid rubber requires a low pressure for molding or the like as compared with a solid rubber, an elastic expanded body with high precision which is low in permanent set based on pressurization can be obtained. Incidentally, in the invention, crosslinking may be carried out simultaneously with the expansion due to release of a supercritical fluid or subcritical fluid.

An Asker-C hardness of the elastic expanded body in the invention is preferably 15° or more and not more than 80°, and more preferably 35° or more and not more than 80°. When the Asker-C hardness is less than 15°, the elastic expanded body is too soft so that even when the edge part is brought into contact with the photoconductor such that it is opposed to the rotation direction thereof, it is hard to apply a pressure enough to achieve cleaning of the toner. Even if a contact pressure of the elastic expanded body is made strong, the edge part may possibly be collapsed. Also, in the case where the Asker-C hardness exceeds 80°, since the cell is not collapsed in the edge part, when the cell is large, the toner passes therethrough so that cleaning failure may possibly occur. The contact pressure is preferably from 0.05 to 20 kg/cm$^2$. Also, a nip width (symbol N in FIG. 1) which is a contact width between the photoconductor and the edge part is preferably from 0.2 to 5 mm. By setting up the nip width as described above, even when a small-sized toner passes through the expanded cell, a possibility that another expanded cell present in a direction of the nip width captures this small-sized toner is extremely high.

Also, an area rate of the cell portion in a cross section of the elastic expanded body elastic expanded body in the invention is preferably 30% or more and not more than 85%, and more preferably 40% or more and not more than 70%. The cleaning performance becomes better within this area rate range.

Figure 2:
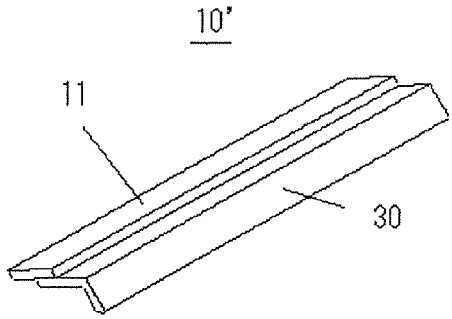
FIG. 2 is an oblique view for explaining a cleaning device of the invention having a reinforcing support unit.
Figure 3:
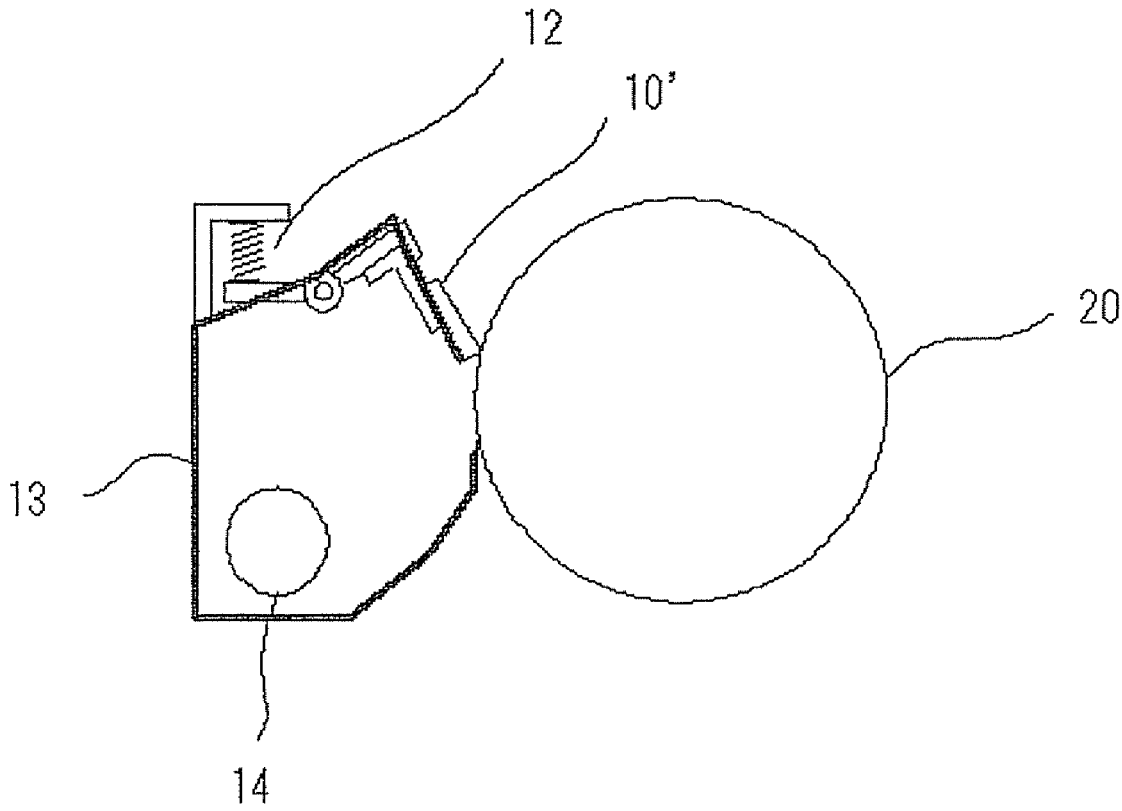
FIG. 3 is a view for explaining one example of a use embodiment of a cleaning device of the invention in an actual image forming apparatus.

The thus prepared elastic expanded body is processed into a blade state having a desired size (for example, thickness: 3 mm, width: 330 mm, length: 12 mm) by properly utilizing centrifugal molding, extrusion molding, shape molding, or the like, whereby it can be fabricated into the cleaning device of the invention. It is preferable that the cleaning device of the invention further includes a reinforcing support unit for pressing the elastic expanded body onto the photoconductor. FIG. 2 is an oblique view for explaining the cleaning device of the invention having a reinforcing support unit. A cleaning device 10' of the invention further includes a reinforcing support unit for pressing an elastic expanded body 11 onto the photoconductor 20 as shown in FIG. 2. In an embodiment of FIG. 2, the reinforcing support unit is a sheet metal 30. In the embodiment of FIG. 2, an adhesive width between the elastic expanded body 11 and the sheet metal 30 was set up at 5 mm, namely a projected length was set up at 7 mm. In an actual image forming apparatus, the cleaning device of the invention can be, for example, used as illustrated in FIG. 3. In FIG. 3, an image forming apparatus 1 is installed with the cleaning device 10' of the invention as a cleaning unit, whereby the residual toner on the photoconductor 20 is scraped off. In the cleaning device 10' of the invention, an edge part of the elastic expanded body 11 is brought into contact with a surface of the photoconductor 20 under a fixed pressure by a spring 12. The scraped off residual toner is recovered within a residual toner recovery box 13 and sent to a non-illustrated waste toner box by an auger 14.

Figure 4:
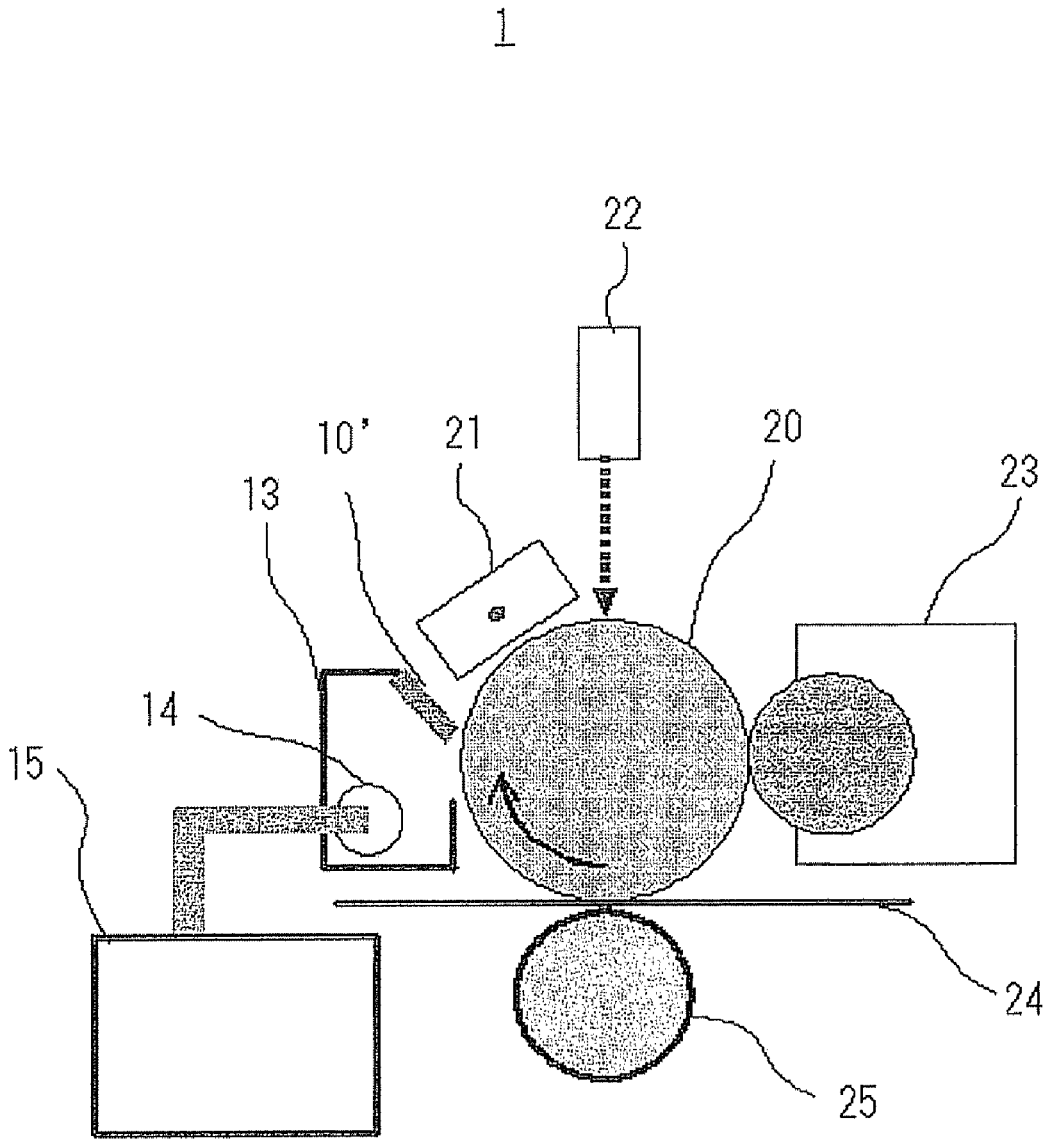
FIG. 4 is an outline view for explaining one example of an image forming apparatus of the invention in more detail.

FIG. 4 is an outline view for explaining one example of the image forming apparatus of the invention in more detail. In FIG. 4, the image forming apparatus 1 is installed with the cleaning device 10' of the invention as a cleaning unit as explained in FIG. 3; the cleaning unit scrapes off the residual toner on the photoconductor 20; and the scraped off residual toner is recovered within the residual toner recovery box 13 and sent to a waste toner box 15 by the auger 14. The photoconductor 20 rotating in an arrow direction is charged by a charging unit 21, and an electrostatic latent image is formed on the photoconductor by an exposure unit 22. Subsequently, the electrostatic latent image is developed with a toner by a development unit 23 to form a toner image, and this toner image is transferred onto a material 24 to be transferred. For the transfer, a nip roller 25 is used, and by pressing the material 24 to be transferred onto the photoconductor 20 under a fixed pressure, whereby the toner image can be transferred onto the material 24 to be transferred.

Figure 5:
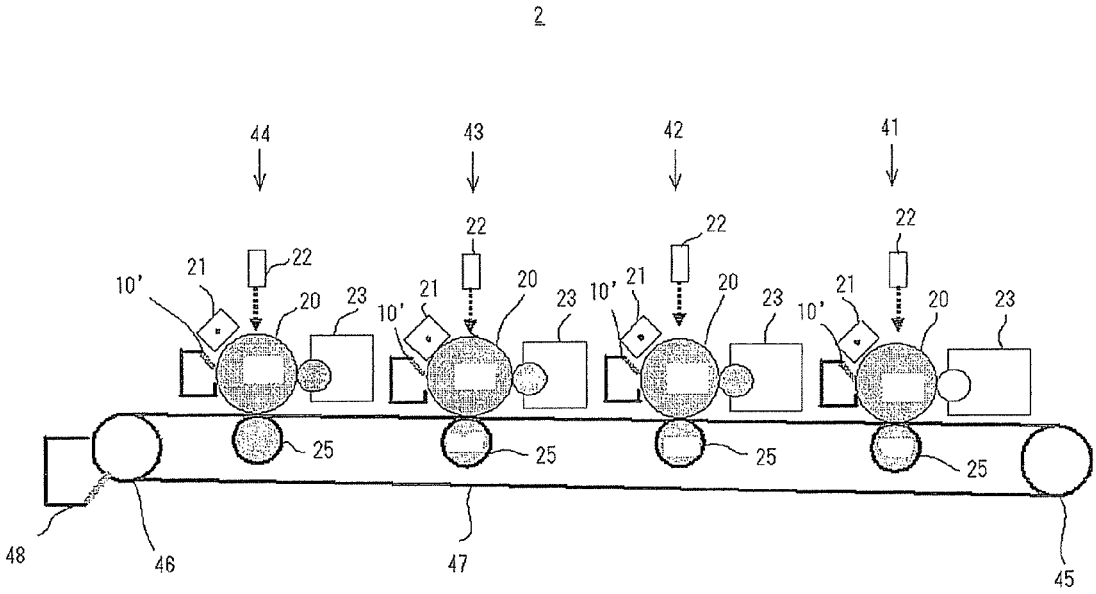
FIG. 5 is an outline view for explaining one example of a tandem type color image forming apparatus provided with a cleaning device of the invention.

FIG. 5 is an outline view for explaining one example of a tandem type color image forming apparatus provided with the cleaning device of the invention. In FIG. 5, a tandem type color image forming apparatus 2 is provided with a yellow development unit 41, a magenta development unit 42, a cyan development unit 43, and a black development unit 44. Each of the development units is provided with the charging unit 21, the exposure unit 22, the development unit 23 and the cleaning device 10' of the invention as explained in FIG. 4. Also, each of the development units includes the nip roller 25 for transfer. A non-illustrated material to be transferred moves on an endless belt 47 due to the rotation of rotation rollers 45 and 46. In the material to be transferred, respective images are transferred by the yellow development unit 41, the magenta development unit 42, the cyan development unit 43 and the black development unit 44, thereby forming a color image. The rotation roller 46 is provided with a belt cleaner unit 48, thereby cleaning a surface of the endless belt 47. Incidentally, when a destaticization function or a charging function is further imparted to the cleaning device of the invention, simplification and miniaturization in size of the image forming apparatus can be achieved, and therefore, such is preferable.

EXAMPLES

A cleaning blade made of an elastic expanded body was prepared from the following materials.

[Samples A1 to A10]

$CO_2$ was impregnated in a composition consisting of 100 parts by weight (hereinafter abbreviated as "parts") of polypropylene glycol (PPG) polyol (manufactured by Nippon Polyurethane Industry Co., Ltd., OH value: 131 mgKOH/g, viscosity: 790 mPa·s/25° C.), 8 parts of carbon black (DENKA BLACK HS100, manufactured by Denki Kagaku Kogyo K. K.), 2 parts of a carbon nanotube and 40 parts of an isocyanate (COLONATE 1407, manufactured by Nippon Polyurethane Industry Co., Ltd.) within an RIM (reaction injection molding) machine under a condition of 10 MPa×50° C.; after mixing, the pressure (0.5 to 5 MPa), the temperature (100 to 150° C.) and the time (10 to 50 minutes) were controlled; and the crosslinking temperature (100 to 200° C.) and the time (15 to 50 minutes) were further controlled, thereby preparing an elastic expanded body and adjusting an expanded cell size and a hardness. Then, a cleaning device as illustrated in FIG. 2 was prepared.

[Samples B1 to B13]

$CO_2$ was impregnated in a composition consisting of 100 parts of liquid EPDM (TRILENE 66, manufactured by Uniroyal Chemical Company Inc., viscosity: 3,500 Pa·s/25° C.), 1 part of stearic acid (manufactured by Tannan Kagaku Kogyo Co., Ltd.), 5 parts of a crosslinking aid (Zinc White No. 1, manufactured by Hakusui Chemical Industries, Ltd.), 8 parts of carbon black (DENKA BLACK HS100, manufactured by Denki Kagaku Kogyo K. K.), 2 parts of a fullerene, 3 parts of a vulcanization accelerator (NOCCELER DM, manufactured by Ouchi Shinko Chemical Industrial Co., Ltd.) and 1.5 parts of a vulcanizer (sulfur, manufactured by Karuizawa Seiren-sha K. K.) within a mixing and casting machine under a condition of 10 MPa×50° C.; after mixing, the pressure (0.5 to 5 MPa), the temperature (100 to 150° C.) and the time (10 to 50 minutes) were controlled; and the crosslinking temperature (100 to 200° C.) and the time (15 to 50 minutes) were further controlled, thereby preparing an elastic expanded body and adjusting an expanded cell size and a hardness. An expanded cell size and a hardness were adjusted. Then, a cleaning device as illustrated in FIG. 2 was prepared.

[Samples C1 and C2]

100 parts of a solid urethane material (UN278, manufactured by Sakai Chemical Industrial Co., Ltd.), 10 parts of carbon black (DENKA BLACK HS100, manufactured by Denki Kagaku Kogyo K. K.), 5 parts of a crosslinking aid (Zinc White No. 1, manufactured by Hakusui Chemical Industries, Ltd.), 1.5 parts of a vulcanizer (sulfur, manufactured by Karuizawa Seiren-sha K. K.), 1 part of a crosslinking accelerator (CURATHANE, manufactured by TSE Industries, Inc.), 2 parts of a crosslinking accelerator (SOXINOL MP, manufactured by Sumitomo Chemical Co., Ltd.), 1 part of a crosslinking accelerator (NOCCELER BZ, manufactured by Ouchi Shinko Chemical Industrial Co., Ltd.), from 4 to 8 parts of DPT as a blowing agent (CELLMIC A, manufactured by Sankyo Kasei Co., Ltd.) and from 4 to 8 parts of a urea based blowing aid (CELLTON N, manufactured by Sankyo Kasei Co., Ltd.) were kneaded; thereafter, the mixture was expanded and crosslinked under a condition at a temperature of from 120 to 180° C. under atmospheric pressure for 20 to 50 minutes; and an expanded cell size and a hardness were adjusted. Then, a cleaning device as illustrated in FIG. 2 was prepared.

With respect to the thus obtained 25 samples, the hardness was measured by using an Asker-C hardness meter (manufactured by Kobunshi Keiki Co., Ltd.). Furthermore, after cutting by a cutter, a cross-sectional photograph of the elastic expanded body was taken by using a microscope (VHX500) manufactured by Keyence Corporation, from which were then determined number particle size distribution values (D50 and D90) of the cell by using LUZEX, manufactured by Nireco Corporation.

The "D10" as referred to herein refers to a size on 10% counted from the small size side of the total number; the "D50" as referred to herein is also called "median size" and refers to a size in 50% of the accumulation (size as a boundary when the whole is divided into two parts); and furthermore, D90 refers to a size in 90% of the accumulation.

Also, an area rate (%) of the cell portion in the cross section at that time against the whole was measured as an expansion rate by using the same measurement instrument. These results are shown in Table 2.

The following materials were used as a toner to be used in tests.

With respect to the toner for test, a polyester toner was prepared by a pulverization method, and toner size and particle size distribution were adjusted by classification. With respect to the particle size, the number particle size distribution values (D10, D50 and D90) were measured by a microtrac particle size distribution analyzer MT3300EX, manufactured by Nikkiso Co., Ltd. The number particle size distribution values (D10, D50 and D90) of the toner for test are shown in Table 1.

The foregoing samples were combined and tested for cleaning performance. For the tests, the image forming apparatus as illustrated in FIG. 4 was used. In a test method for the cleaning performance, in an initial state where the number of accumulated printed sheets is not more than 1,000, a solid pattern with a printing rate of 100% was printed on A4-size paper, and immediately after continuously printing three sheets thereof, white paper with a printing rate of 0% was passed, thereby confirming a state of staining of the paper. On that occasion, the case where staining does not occur at all was designated as "○"; the case where though scumming is seemed to be slightly present, there is substantially no problem was designated as "Δ"; and the case where staining occurs was designated as "X>".

Furthermore, in the foregoing initial state, a solid pattern with a printing rate of 100% was printed on A4-size paper, and immediately after continuously printing three sheets thereof, the surface of the photoconductor after completion of a cleaning step was taped by a mending tape, thereby confirming whether or not cleaning failure occurred. The cleaning failure was evaluated in terms of a difference in reflectance(%). The mending tape peeled away from the photoconductor was stuck onto white paper and a reflectance (R1) at that time was measured; and a mending tape which had not been stuck onto the photoconductor was similarly stuck on white paper and a reflectance (R2) was measured, thereby defining the difference in reflectance (%) as [difference in reflectance]=(1−(R1/R2))×100%. That is, it is meant that when the difference in reflectance is 0%, cleaning is completely achieved, whereas when it is 100%, cleaning is not achieved at all. Here, though what the difference in reflectance is small as far as possible is desired, when it is in general not more than 3%, adverse influences are not brought on the image.

Moreover, a character chart with a printing rate of 6% was printed on 30,000 sheets; thereafter, after allowing to stand under an environmental condition at a temperature of 10° C. and at a relative humidity of 20% for 8 hours, a solid pattern with a printing rate of 100% was printed; after continuously printing three sheets thereof, staining of paper and difference in reflectance were measured in the same manners as described above.

The results are shown in Table 2.

TABLE 1

| Sample No. | Particle size distribution value D10 (μm) | Particle size distribution value D50 (μm) | Particle size distribution value D90 (μm) |
|---|---|---|---|
| Toner A | 2.5 | 4.5 | 6.5 |
| Toner B | 3.5 | 4.6 | 6.4 |
| Toner C | 3.5 | 5.9 | 8.4 |

TABLE 2

| | | | | | Difference in reflectance (%) of photoconductor surface after passing through cleaning and staining of white paper after solid printing at that time | | | | | |
|---|---|---|---|---|---|---|---|---|---|---|
| | | | | | Toner A | | | | Toner B | |
| Sample No. | Particle size distribution value D10 of cell (μm) | Particle size distribution value D90 of cell (μm) | Hardness (Asker-C)° | Area rate of cell (%) | Initial state | Staining of paper | After printing 30,000 sheets at 10° C. and 20% | | Initial state | Staining of paper |
| Conventional polyurethane blade | | | 50 | — | 2 | ○ | 10 | X | 1.5 | ○ |
| A1 | 0.5 | 2 | 42 | 51 | 1 | ○ | 9 | X | 1 | ○ |
| A2 | 0.7 | 2.1 | 41 | 52 | 1 | ○ | 2 | ○ | 1 | ○ |
| A3 | 0.8 | 2 | 42 | 53 | 1 | ○ | 1.5 | ○ | 1 | ○ |
| A4 | 0.9 | 2.1 | 42 | 52 | 1 | ○ | 1.5 | ○ | 1 | ○ |
| A5 | 1.5 | 5 | 42 | 47 | 1 | ○ | 1.5 | ○ | 1 | ○ |
| A6 | 60 | 120 | 41 | 60 | 1.5 | ○ | 1.5 | ○ | 1 | ○ |

TABLE 2-continued

| | | | | | | | | | | |
|---|---|---|---|---|---|---|---|---|---|---|
| A7 | 70 | 130 | 40 | 47 | 4 | Δ | | | 1 | ○ |
| A8 | 90 | 170 | 40 | 55 | 10 | X | | | 1 | ○ |
| A9 | 100 | 180 | 39 | 58 | 12 | X | | | 4 | Δ |
| A10 | 130 | 210 | 38 | 52 | 16 | X | | | 11 | X |
| C1 | 19 | 190 | 39 | 59 | 23 | X | | | 15 | X |
| C2 | 30 | 230 | 39 | 55 | 30 | X | | | 22 | X |
| B1 | 9 | 40 | 11 | 49 | 10 | X | | | 8 | X |
| B2 | 10 | 44 | 15 | 59 | 2.5 | ○ | 2 | ○ | 2 | ○ |
| B3 | 10 | 42 | 30 | 46 | 1 | ○ | 1 | ○ | 1 | ○ |
| B4 | 11 | 40 | 35 | 61 | 1 | ○ | 2 | ○ | 1 | ○ |
| B5 | 11 | 41 | 63 | 55 | 2 | ○ | 2 | ○ | 2 | ○ |
| B6 | 10 | 40 | 80 | 51 | 2 | ○ | 2 | ○ | 2 | ○ |
| B7 | 9 | 41 | 85 | 47 | 3 | ○ | 5.5 | Δ | 3 | ○ |
| B8 | 12 | 42 | 89 | 48 | 4 | Δ | 7 | X | 4 | Δ |
| B9 | 11 | 39 | 40 | 20 | 2 | ○ | 7 | Δ | 2 | ○ |
| B10 | 11 | 38 | 41 | 30 | 1 | ○ | 3 | ○ | 1 | ○ |
| B11 | 10 | 39 | 39 | 41 | 1 | ○ | 1 | ○ | 1 | ○ |
| B12 | 11 | 41 | 39 | 65 | 1 | ○ | 1 | ○ | 1 | ○ |
| B13 | 12 | 40 | 39 | 85 | 2 | ○ | 3 | ○ | 2 | ○ |

| | | | Difference in reflectance (%) of photoconductor surface after passing through cleaning and staining of white paper after solid printing at that time | | | | | |
|---|---|---|---|---|---|---|---|---|
| | | | Toner B | | Toner C | | | |
| Sample No. | Particle size distribution value D10 of cell (μm) | Particle size distribution value D90 of cell (μm) | After printing 30,000 sheets at 10° C. and 20% | Staining of paper | Initial state | Staining of paper | After printing 30,000 sheets at 10° C. and 20% | Staining of paper |
| Conventional polyurethane blade | | | 10 | X | 1.5 | ○ | 10 | X |
| A1 | 0.5 | 2 | 13 | X | 0.5 | ○ | 13 | X |
| A2 | 0.7 | 2.1 | 7.5 | X | 0.5 | ○ | 8 | X |
| A3 | 0.8 | 2 | 5 | Δ | 0.5 | ○ | 6 | X |
| A4 | 0.9 | 2.1 | 3 | ○ | 0.5 | ○ | 3 | ○ |
| A5 | 1.5 | 5 | 1.5 | ○ | 0.5 | ○ | 0.5 | ○ |
| A6 | 60 | 120 | 1.5 | ○ | 0.5 | ○ | 0.5 | ○ |
| A7 | 70 | 130 | 1.5 | ○ | 0.5 | ○ | 0.5 | ○ |
| A8 | 90 | 170 | 1.5 | ○ | 0.5 | ○ | 0.5 | ○ |
| A9 | 100 | 180 | | | 5.5 | Δ | | |
| A10 | 130 | 210 | | | 11.5 | X | | |
| C1 | 19 | 190 | | | 16 | X | | |
| C2 | 30 | 230 | | | 22 | X | | |
| B1 | 9 | 40 | | | 7 | X | | |
| B2 | 10 | 44 | 2 | ○ | 2 | ○ | 2 | ○ |
| B3 | 10 | 42 | 1.5 | ○ | 0.5 | ○ | 0.5 | ○ |
| B4 | 11 | 40 | 2 | ○ | 0.5 | ○ | 2 | ○ |
| B5 | 11 | 41 | 2 | ○ | 2 | ○ | 2 | ○ |
| B6 | 10 | 40 | 2 | ○ | 2 | ○ | 2 | ○ |
| B7 | 9 | 41 | 6 | Δ | 3.5 | ○ | 5.5 | Δ |
| B8 | 12 | 42 | 7 | X | 4 | Δ | 6.5 | X |
| B9 | 11 | 39 | 7 | X | 2 | ○ | 7 | X |
| B10 | 11 | 38 | 3 | ○ | 0.5 | ○ | 3 | ○ |
| B11 | 10 | 39 | 1.5 | ○ | 0.5 | ○ | 0.5 | ○ |
| B12 | 11 | 41 | 1.5 | ○ | 0.5 | ○ | 0.5 | ○ |
| B13 | 12 | 40 | 3 | ○ | 2 | ○ | 3 | ○ |

Figure 6:
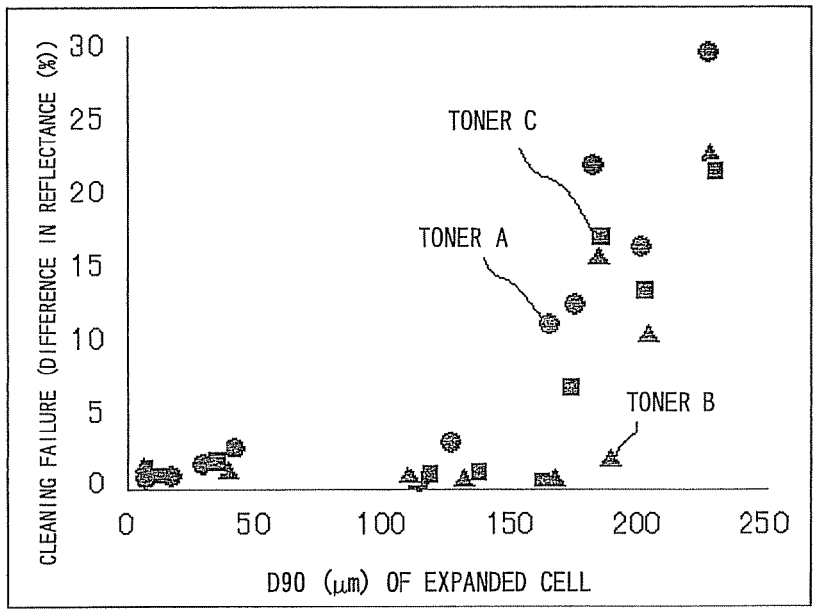
FIG. 6 is a graph to show a relationship of a number particle size distribution value D90 of an expanded cell of a cleaning blade and a number particle size distribution value D10 of a toner vs. a cleaning performance in an initial state.

FIG. 6 is a graph to show a relationship of a number particle size distribution value D90 of an expanded cell of a cleaning blade and a number particle size distribution value D10 of a toner vs. a cleaning performance in an initial state. In the toner A, cleaning is good in a region where D90 of the expanded cell is in general not more than 125 μm; and in the toners B and C, so far as D90 of the expanded cell is not more than 175 μm, a good cleaning performance is obtained. That is, D90 of the expanded cell is corresponding to a value of approximately 50 times of D10 of the toner, but correlation with other values of the toner (D50 and D90) is not particularly found. Here, in the samples C1 and C2 which are a cleaning blade prepared not according to the measure using a supercritical fluid, D90 of the expanded cell could not be made small and after all, became 190 μm even at minimum. When the same test by using this cleaning blade was carried out, D90 of the expanded cell was too large so that good cleaning could not be performed from the beginning. It is thought that this is caused due to the matter that in the expansion measure not using a supercritical fluid, as is clear from D10 of the expanded cell, the distribution of the expanded cell size is broad as compared with that in a measure using a supercritical fluid, and as a result, uniform pressure distribution is hardly obtained in the edge part of the cleaning blade, whereby a margin of the cleaning condition becomes narrow. In contrast thereto, since the samples A1 to A9 are concerned with an expansion measure using a supercritical fluid, the expanded cell size is uniformly controlled. For that reason, a good performance is obtained as compared with the samples C1 and C2.

Figure 7:
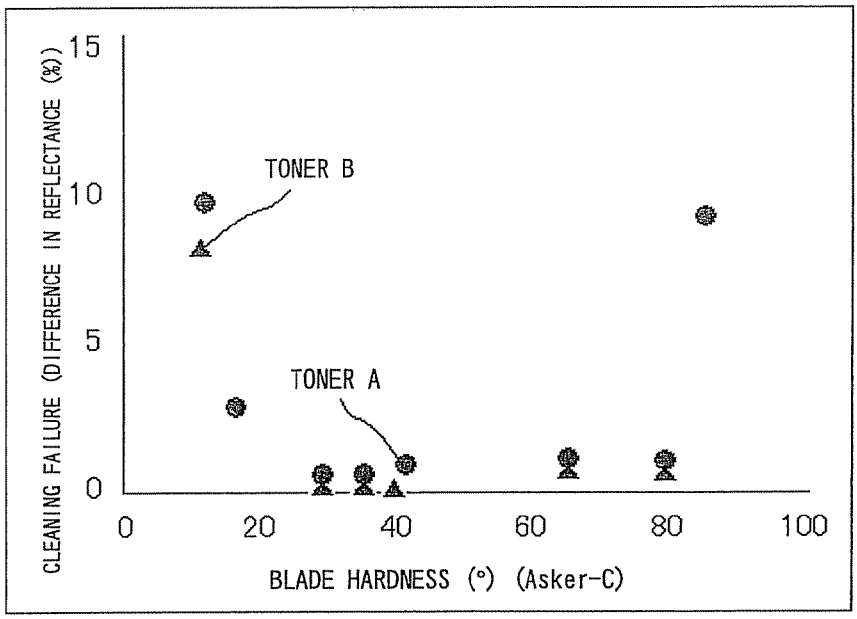
FIG. 7 is a graph to show a relationship between a hardness of a cleaning blade and a cleaning performance in an initial state.

FIG. 7 is a graph to show a relationship between a hardness of a cleaning blade and a cleaning performance in an initial state. It is noted that good characteristics are obtained within a range of the hardness of the cleaning blade of from 15 to 80° irrespective of the toners A, B and C. Incidentally, in FIG. 7, the expanded cells which do not meet the foregoing requirements (1) and (2) of the invention are not plotted.

Figure 8:
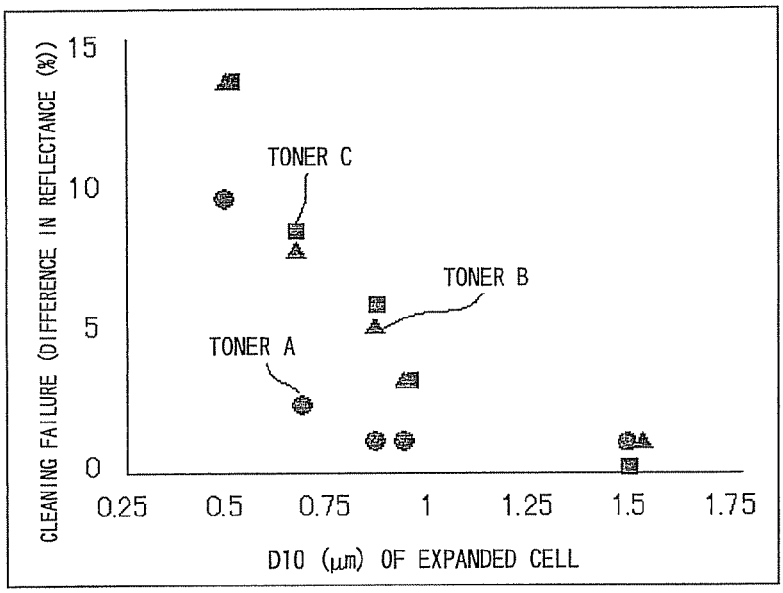
FIG. 8 is a graph to show a relationship of a number particle size distribution value D10 of an expanded cell of a cleaning blade and a number particle size distribution value D10 of a toner vs. a cleaning performance after printing 30,000 sheets and after allowing to stand at a temperature of 10° C. and at a relative humidity of 20% for 8 hours.

FIG. 8 is a graph to show a relationship of a number particle size distribution value D10 of an expanded cell of a cleaning blade and a number particle size distribution value D10 of a toner vs. a cleaning performance after printing 30,000 sheets and after allowing to stand at a temperature of 10° C. and at a relative humidity of 20% for 8 hours. It is noted from FIG. 8 that when D10 of the expanded cell is too small, a good cleaning performance is not obtained. With respect to this matter, there is also a correlation therebetween, and it is required that D10 of the expanded cell is in general larger than [D10×(¼)] of the toner. With respect to this matter, the foregoing reasons may be thought, and it is estimated that in general, D10 of the expanded cell at which the fine particulate toner rolls hardly falls within this range.

Figure 9:
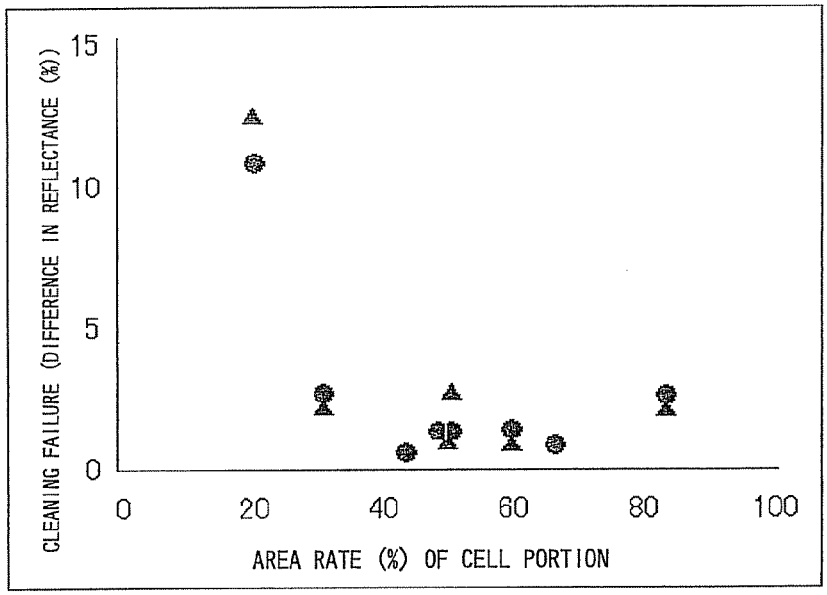
FIG. 9 is a graph to show a relationship of an area rate of a cell portion of a cleaning blade vs. a cleaning performance after printing 30,000 sheets and after allowing to stand at a temperature of 10° C. and at a relative humidity of 20% for 8 hours.

Also, FIG. 9 is a graph to show a relationship of an area rate of a cell portion of a cleaning blade vs. a cleaning performance after printing 30,000 sheets and after allowing to stand at a temperature of 10° C. and at a relative humidity of 20% for 8 hours. It is noted from FIG. 9 that when the area rate of the cell portion is in general from 30 to 85%, a good cleaning performance is obtained. Incidentally, in FIG. 9, the expanded cells which do not meet the foregoing requirements (1) and (2) of the invention are not plotted.

Figure 10:
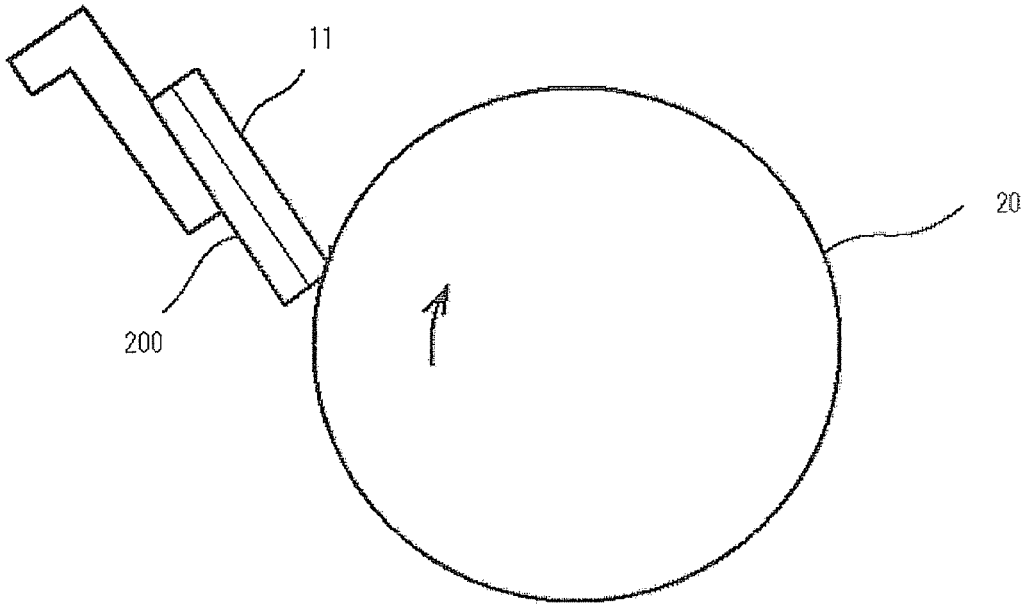
FIG. 10 is a view for explaining an embodiment in which a backing material having a hardness higher than an elastic expanded body is stuck in a back side of the elastic expanded body.

Next, with respect to the above obtained cleaning blade A5, continuous paper-passing of 10,000 sheets was carried out in a high temperature and high humidity environment (temperature: 30° C., relative humidity: 85%). As a result, the whole of the blade was turned up. Then, as illustrated in FIG. 10, a configuration that a backing material 200 made of a urethane resin (thickness: 1 mm or 1.5 mm) is stuck from a back side of the cleaning blade, whereby the whole of the blade is hardly turned up was employed. By stacking a material having a hardness higher than the elastic expanded body 11 onto the back side of the elastic expanded boy, it is possible to prevent the blade from being turned up, and such is preferable. A urethane rubber which is used for usual blade cleaners but not an expanded body can be used as the urethane resin to be stuck. Here, a urethane rubber blade having a hardness (Asker-C) of 500 was used and stuck onto the elastic expanded body with an adhesive. A cleaning blade made of the obtained stack was used and evaluated in the same manner as described above. The results are shown in Table 3. By stacking a backing material onto the expanded elastic body 11, even in printing works of 10,000 sheets in a high temperature and high humidity environment, it became possible to achieve cleaning without problems.

Also, the results obtained by carrying out printing works of 10,000 sheets in a high temperature and high humidity environment by changing the hardness of the cleaning blade without stacking a backing material onto the expanded elastic body are also shown in Table 3.

As the blade sample, B2 to B6 were used as they were. As a result, it is noted that though when the hardness is not more than 300, turning up occurred in a high temperature and high humidity environment, when the hardness is 35° or more, turning up did not occur, thereby the blade can be used even without providing a backing material.

Also, in the foregoing Examples, by increasing the amount of addition of the carbon nanotube and imparting a destaticization function of a photoconductor to the cleaning blade, the evaluation was performed in the same manner as described above. The results are also shown in Table 3. (1) a blade in which the amount of carbon black is largely increased (amount of addition: 15 parts), and a resistivity value of the blade is adjusted at from $10^6$ to $10^9$ Ω.cm (a volume resistivity was measured by a HIRESTA HR100 probe 500 v, manufactured by Mitsubishi Petrochemical Co., Ltd.) as in a known a destaticization function-provided cleaning blade; (2) a blade in which the amount of addition of the carbon nanotube is increased (amount of addition: 8 parts) without changing the amount of addition of carbon black, and a resistivity value of the blade is adjusted at the same value as described above; and (3) a blade in which the amount of addition of the carbon nanotube is adjusted at the same value as in (2), the amount of addition of carbon black is decreased (amount of addition: 2 parts) and a decreased portion thereof is supplemented by the addition of a fullerene, and a resistivity value is adjusted at the same value as in the foregoing blade were compared. As a result, in the foregoing destaticization blade (1), the printing works did not reach 30,000 sheets, a large breakage was generated in the blade, and cleaning failure occurred. In the foregoing destaticization blade (2), good cleaning properties could be kept even after printing works of 30,000 sheets. It is thought that this is caused due to the matter that since the amount necessary for realizing the same conductivity in the carbon nanotube may be from ⅙ to ¼ of that of carbon black, the blade does not become brittle due to the addition of more than the necessary amount, and therefore, a breakage is hardly generated. Also, in the foregoing destaticization blade (3), even when printing works of 30,000 sheets was additionally carried out after the printing works of 30,000 sheets, abrasion resistance was improved, and cleaning failure did not occur. On the other hand, in the foregoing destaticization blade (2), cleaning failure occurred by abrasion under the same condition. Incidentally, an effect for improving abrasion of a fullerene is not limited to the destaticization blade. In the present Examples, while a destaticization blade has been enumerated as the conductive blade, needless to say, the same effects are, as a matter of course, brought even in blades for charging a photoconductor or a belt or the like.

TABLE 3

| Sample | Particle size distribution value D50 of cell (μm) | Particle size distribution value D90 of cell (μm) | Hardness (Asker-C)° | Area rate of cell (%) | Difference in reflectance (%) of photoconductor surface after passing through cleaning and staining of white paper after solid printing at that time: Initial state | Staining of paper | After printing 30,000 sheets at 10° C. and 20% |
|---|---|---|---|---|---|---|---|
| A5 | 1.5 | 5 | 42 | 47 | 1 | ○ | 1.5 |
| A5 + Sticking (thickness: 1 mm) | | | | | 1 | ○ | 1.5 |
| A5 + Sticking (thickness: 1.5 mm) | | | | | 1 | ○ | 1.5 |
| B2 | 10 | 44 | 15 | 59 | 25 | ○ | 2 |
| B3 | 10 | 42 | 30 | 46 | 1 | ○ | 1 |
| B4 | 11 | 40 | 35 | 61 | 1 | ○ | 2 |
| B5 | 11 | 41 | 63 | 55 | 2 | ○ | 2 |
| B6 | 10 | 40 | 80 | 51 | 2 | ○ | 2 |
| Conductive blade with an increased amount of carbon black | 9 | 38 | 70 | 53 | 2 | ○ | 12 |
| Conductive blade having a decreased resistivity with carbon nanotube | 10 | 39 | 65 | 53 | 2 | ○ | 2 |
| Conductive blade having a fullerene further added thereto | 10 | 40 | 66 | 54 | 2 | ○ | 2 |

| Sample | Difference in reflectance (%) of photoconductor surface after passing through cleaning and staining of white paper after solid printing at that time: Staining of paper | Printing of 10,000 sheets in high temperature and high humidity environment | Staining of paper | After printing additional 30,000 sheets at 10° C. and 20% | Staining of paper |
|---|---|---|---|---|---|
| A5 | ○ | Turning up occurred on on the way | | | |
| A5 + Sticking (thickness: 1 mm) | ○ | 1 | ○ | 2.5 | ○ |
| A5 + Sticking (thickness: 1.5 mm) | ○ | 1 | ○ | 2.5 | ○ |
| B2 | ○ | Turning up occurred on the way | | | |
| B3 | ○ | Turning up occurred on the way | | | |
| B4 | ○ | 1 | ○ | 2.5 | ○ |
| B5 | ○ | 1 | ○ | 2.5 | ○ |
| B6 | ○ | 1 | ○ | 2.5 | ○ |
| Conductive blade with an increased amount of carbon black | X | | | | |
| Conductive blade having a decreased resistivity with carbon nanotube | ○ | 1 | ○ | 11 | X |
| Conductive blade having a fullerene further added thereto | ○ | 1 | ○ | 1 | ○ |

While the invention has been described in detail with reference to specific embodiments thereof, it will be apparent to one skilled in the art that various changes and modifications can be made therein without departing from the spirit and scope thereof.

As described above in detail, according to the invention, it is possible to provide a cleaning device employing an elastic expanded body for blade cleaning and capable of imparting excellent cleaning performance and durability and an image forming apparatus using the same.

What is claimed is:

1. A cleaning device disposed in contact with a surface of an image carrier and scraping off a residual toner on the surface of the image carrier, wherein the cleaning device includes an edge part coming into contact with the surface of the image carrier;

the edge part is made of an elastic expanded body having an expanded cell; and number particle size distribution values D10 and D90 of the expanded cell meet the following requirements (1) and (2) against a number particle size distribution value D10 of the toner:

(1) the number particle size distribution value D10 of the expanded cell is ¼ times or more of the number particle size distribution value D10 of the toner, and (2) the number particle size distribution value D90 of the expanded cell is not more than 50 times of the number particle size distribution value D10 of the toner.

2. The cleaning device according to claim 1, wherein the edge part has a fine three-dimensional concave-convex structure due to the expanded cell and forms a discontinuous contact surface against the surface of the image carrier.

3. The cleaning device according to claim 1, wherein the elastic expanded body has an Asker-C hardness of 15° or more and not more than 80°.

4. The cleaning device according to claim 3, wherein the elastic expanded body has an Asker-C hardness of 35° or more and not more than 80°.

5. The cleaning device according to claim 1, wherein an area rate of a cell portion in a cross section of the elastic expanded body is 30% or more and not more than 85%.

6. The cleaning device according to claim 1, wherein the cleaning device further includes a reinforcing support means for pressing the elastic expanded body onto the image carrier.

7. The cleaning device according to claim 1, wherein the elastic expanded body contains, as an additive, at least one member selected from the group consisting of a carbon nanotube and fullerene.

8. The cleaning device according to claim 1, wherein the cleaning device is provided with a destaticization function or a charging function.

9. The cleaning device according to claim 2, wherein the elastic expanded body is one prepared via a step in which after introducing a liquid rubber into a subcritical or supercritical fluid, the subcritical or supercritical fluid is released from the liquid rubber.

10. The cleaning device according to claim 9, wherein the subcritical or supercritical fluid is carbon dioxide.

11. The cleaning device according to claim 1, wherein a material having a hardness higher than the elastic expanded body is stacked in a back side of the elastic expanded body.

12. An image forming apparatus including an image forming means for forming an electrostatic latent image on an image carrier, a development means for developing the electrostatic latent image formed by the image forming means with a toner to form a toner image, a transfer means for transferring the toner image developed by the development means onto a material to be transferred, and a cleaning means disposed in contact with a surface of the image carrier and scraping off the residual toner on the surface of the image carrier after the transfer, wherein the cleaning means is composed of the cleaning device according to claim 1.

* * * * *